US006481909B2

(12) United States Patent
Lee

(10) Patent No.: US 6,481,909 B2
(45) Date of Patent: Nov. 19, 2002

(54) APPEARING AND DISAPPEARING CORE TYPE WRITING UTILITY

(76) Inventor: Byung Ho Lee, 50 Bosudong 1-ga, Joong-gu, Pusan (KR)

( * ) Notice: Subject to any disclaimer, the term of this patent is extended or adjusted under 35 U.S.C. 154(b) by 0 days.

(21) Appl. No.: 09/960,286

(22) Filed: Sep. 21, 2001

(65) Prior Publication Data

US 2002/0039512 A1 Apr. 4, 2002

(30) Foreign Application Priority Data

Sep. 28, 2000 (KR) ..... 00-27213

(51) Int. Cl.[7] ..... B43K 21/08
(52) U.S. Cl. ..... 401/116; 401/75
(58) Field of Search ..... 401/75, 116, 55, 401/68, 99

(56) References Cited

U.S. PATENT DOCUMENTS 3,205,864 A * 9/1965 Young ..... 401/75
5,551,787 A * 9/1996 Rosenthal ..... 401/75 X
6,155,734 A * 12/2000 Kageyama et al. ..... 401/75

FOREIGN PATENT DOCUMENTS

DE 3826691 * 2/1989 ..... 401/116

* cited by examiner

*Primary Examiner*—Timothy L. Maust
*Assistant Examiner*—Kathleen J. Prunner
(74) *Attorney, Agent, or Firm*—Harness, Dickey & Pierce, P.L.C.

(57) ABSTRACT

The present invention relates to an appearing and disappearing core type writing instrument capable of appearing and disappearing a core based on a rotation operation. The writing instrument includes a hollow cylindrical body having an opened front end, a driving member which is engaged at an intermediate portion of the body in such a manner that the driving member is not rotated with respect to the body, a hollow cylindrical guide inserted into the front end of the body and rotatably engaged to the body, and a moving rod which is threadedly engaged with the driving member and is forwardly and backwardly moved by the driving member which is integrally rotated with the body for thereby appearing and disappearing the core through a front end portion of the guide in a state that the core is engaged to the front end of the moving rod and is inserted into the guide and is inserted into the non-rotational through hole formed at the rear end of the guide in such a manner that the moving rod is movable in the forward and backward directions.

4 Claims, 4 Drawing Sheets

APPEARING AND DISAPPEARING CORE TYPE WRITING UTILITY

BACKGROUND OF THE INVENTION

1. Field of the Invention

The present invention relates to an appearing and disappearing core type writing instrument capable of appearing or disappearing a core of a writing instrument based on rotation.

2. Description of the Background Art

In the conventional art, various kinds of appearing and disappearing core type writing instruments in which a core appears and disappears based on a pushing or rotating operation are known. However, the above-described conventional appearing and disappearing core type writing instruments have a complicated construction, and the fabrication cost is high. In addition, the durability is weak, and the life span is short. Furthermore, there are many elements which are worn out due to friction, so that a desired operation can not be implemented. In addition, it is difficult to handle the conventional appearing and disappearing core type writing instruments.

SUMMARY OF THE INVENTION

Accordingly, it is an object of the present invention to provide an appearing and disappearing core type writing instrument which is capable of implementing a simple construction, low fabrication cost and good durability. In addition, it is easy to handle the writing instrument based on the small number of the friction elements.

To achieve the above objects, there is provided an appearing and disappearing type writing instrument which includes a hollow cylindrical body having an opened front end, a driving member which is engaged at an intermediate portion of the body in such a manner that the driving member is not rotated with respect to the body, a hollow cylindrical guide inserted into the front end of the body and rotatably engaged to the body, and a moving rod which is threadedly engaged with the driving member and is forwardly and backwardly moved by the driving member which is integrally rotated with respect to the body for thereby appearing and disappearing the core through a front end portion of the guide in a state that the core is engaged to the front end of the moving rod and is inserted into the guide and is inserted into the non-rotational through hole formed at the rear end of the guide in such a manner that the moving rod is movable in the forward and backward directions.

The guide is rotatable with respect to the body in such a manner that a protrusion and groove formed in parallel along an outer surface of the end portion of the same are inserted into concave and convex portions formed in parallel along an inner surface of the front end of the body.

The driving member is not rotatable with respect to the body in such a manner that a threaded portion formed in an outer surface of the driving member is engaged with a threaded portion formed in an inner surface of the body.

The moving rod is a rod having a rectangular cross section having a threaded portion formed at both side surfaces, and a through hole formed in the rear end of the guide into which the moving rod is inserted is of rectangular shape to correspond with the cross section of the moving rod.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The present invention will be explained with reference to the accompanying drawings.

Figure 1:
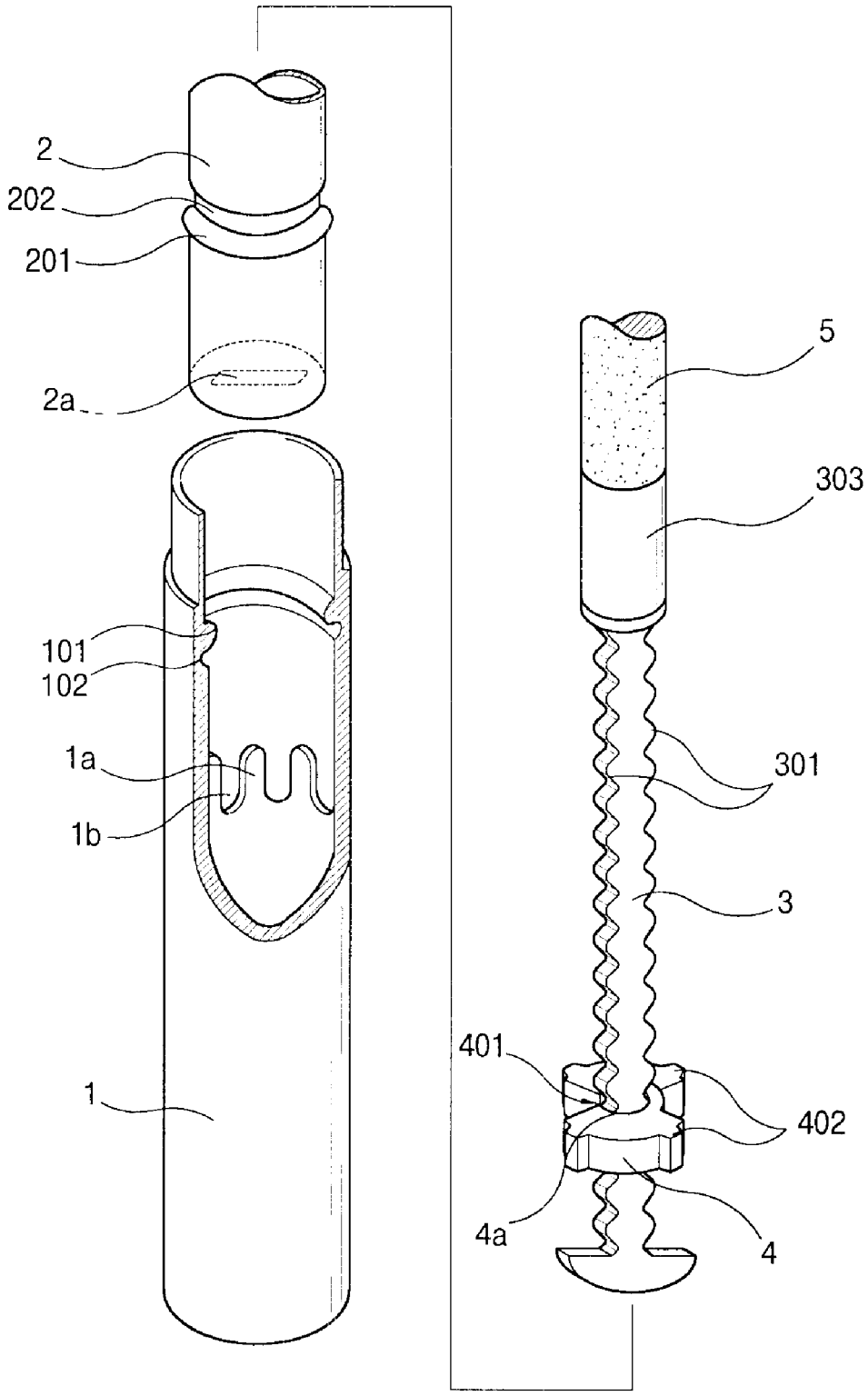
FIG. 1 is an exploded perspective view illustrating an appearing and disappearing core type writing instrument according to the present invention.
Figure 2:
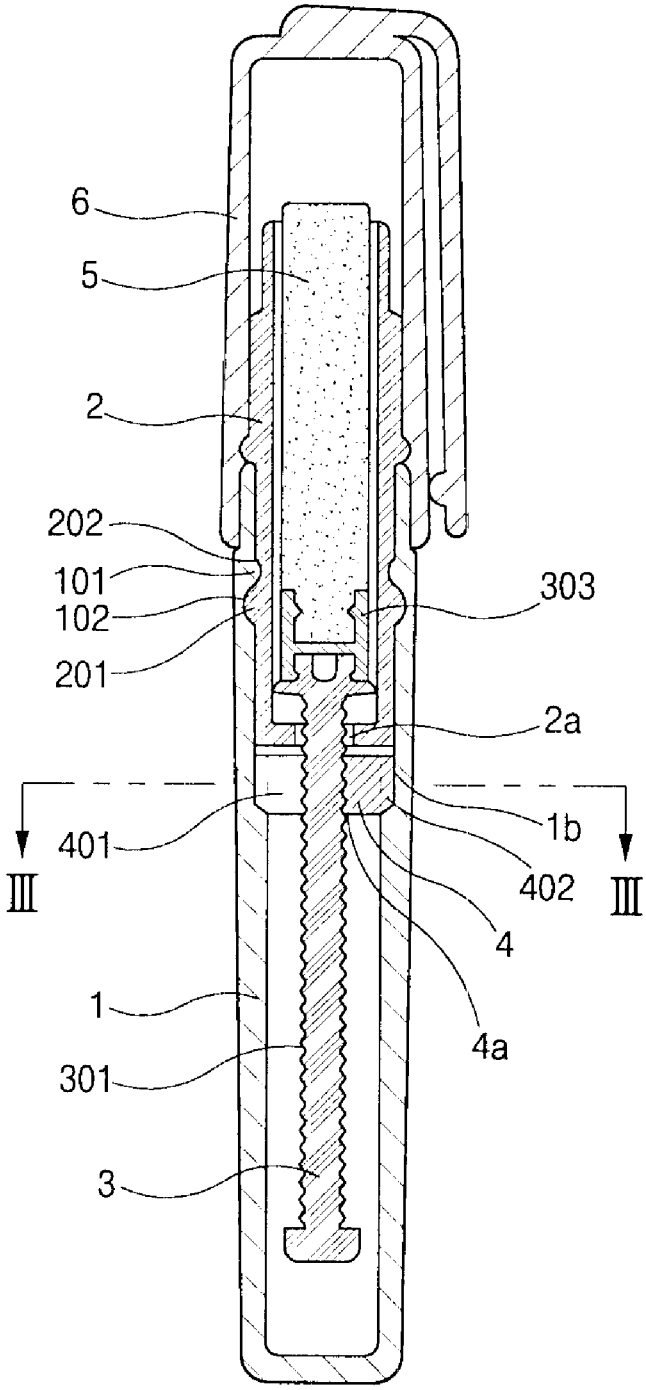
FIG. 2 is a vertical cross-sectional view illustrating an appearing and disappearing core type writing instrument according to the present invention.

As shown in FIGS. 1 and 2, the appearing and disappearing core type writing instrument according to the present invention includes a hollow cylindrical body 1, a hollow guide 2 rotatably engaged to a front end of the body 1 and having an opened front end, a driving member 4 which is not rotatable with respect to the body in an inner intermediate portion of the body 1, a moving rod 3 which has a front end to which a core 5 is engaged and is threadedly engaged with the driving member 4 through a through hole 2*a* formed in a rear end of the guide 2, and a lid 6 inserted onto a front end of the guide 2 for covering the guide 2 and core 5.

The body 1 is formed of a hollow cylindrical member and forms a main body of the appearing and disappearing type writing instrument according to the present invention. The body 1 includes an opened front end and a concave portion 1*b* and a concave portion 1*a* which are arranged alternately in a radial direction in the inner intermediate portion for engaging the driving member 4. A protrusion 101 and a groove 102 are formed in the front end for engaging with the guide 2.

The guide 2 is formed of a hollow cylindrical member which has an opened front end and a closed rear end, and a part of the rear end of the same is inserted into the front end of the body 1, and a groove 202 and a protrusion 201 formed in the rear end are tightly inserted into the protrusion 101 and the groove 102 formed in the front end of the body 1, so that the groove 202 and the protrusion 201 are rotatable with respect to the body 1. In other words, the body 1 is rotatable with respect to the guide 2. A rectangular through hole 2*a* which is not movable is engaged to a rear end of the guide 2.

Figure 3:
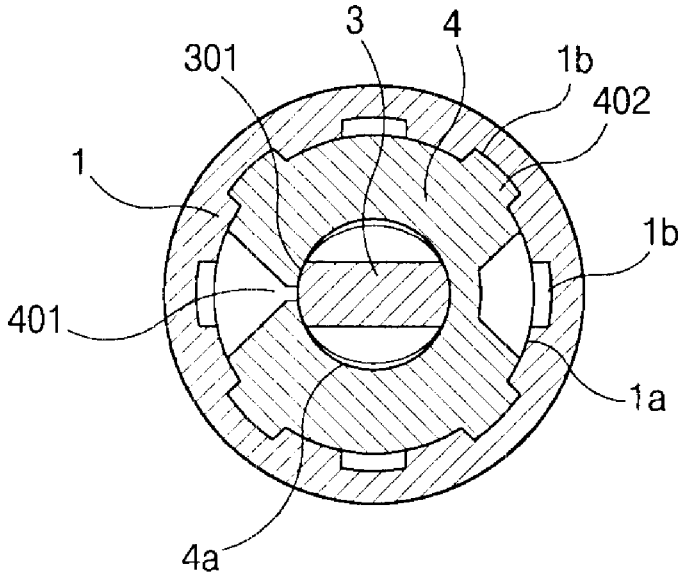
FIG. 3 is a cross-sectional view taken along line III—III of FIG. 2.

As shown in FIGS. 1 and 3, the driving member 4 includes a screw hole 4*a* formed in the center portion of the same and is formed of an elastic circular member in which an insertion member 401 is formed for opening the screw hole 4*a*. A plurality of protrusions 402 are inserted into the concave portion 1*b* formed in the interior of the body 1 for thereby preventing the rotation with respect to the body 1. The driving member 4 is rotated together with the body 1.

The moving rod 3 is formed of a rod having a rectangular cross section in which a threaded portion 301 corresponding to the screw hole 4*a* of the driving member 4 is formed. A holder 303 to which the core 5 is engaged is installed at the front end of the same. The moving rod 3 is inserted into the guide 2 and the through hole 2*a* formed in the rear end of the guide 2 and includes a rear end which is inserted into the insertion member 401 and then is threadedly engaged with the screw hole 4*a* of the driving member 4. The through hole 2*a* of the guide 2 has a non-rotatable shape, namely, a rectangular cross section, so that the relative rotation with respect to the guide 2 is prevented, and the front and read direction movements are permitted. The moving rod 3 is forwardly and backwardly moved by the driving member 4 which is rotated together with the body 1, and the core 5 engaged to the holder 303 appears and disappears through the front end of the guide 2.

The operation of the appearing and disappearing core type writing instrument according to the present invention will be explained with reference to the accompanying drawings.

Figure 4:
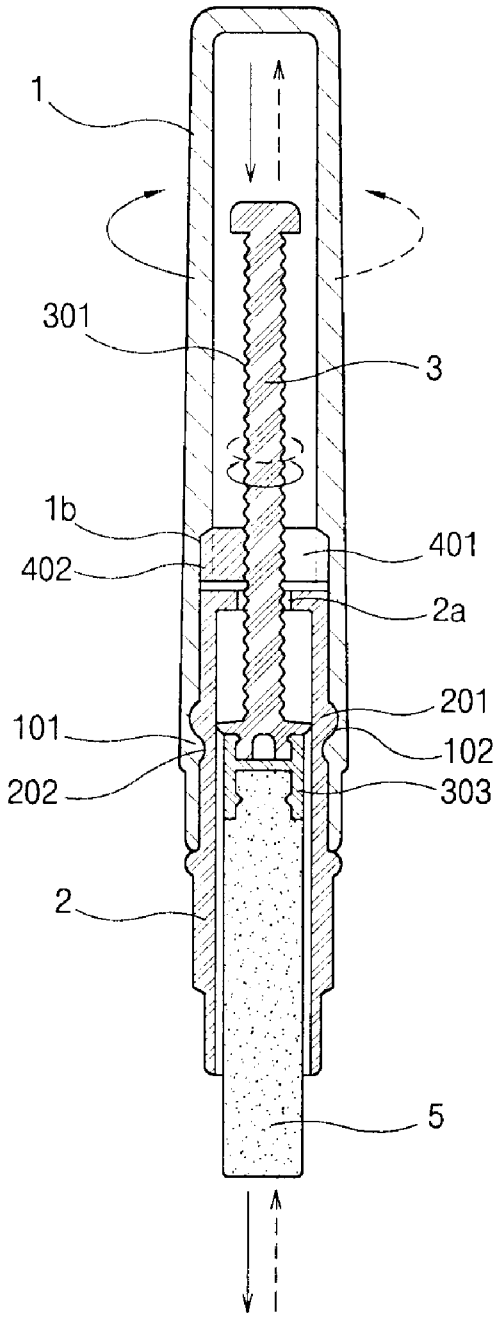
FIG. 4 is a vertical cross-sectional view illustrating an operation principle of an appearing and disappearing core type writing instrument according to the present invention.

In a state that a user opens the lid and holes the guide 2 using one hand, the user rotates the body 1 in the clockwise direction (the full line arrow in FIG. 4) using the other hand. The driving member 4 which is rotated together with the body 1 which is threadedly engaged with the driving member 4 forwardly moves the moving rod 3 in which the forward movement of the same is prevented by the guide 2. Therefore, the core 5 engaged toe holder 303 of the front end of the moving rod 3 appears to the outside of the front end of the guide 2, so that the user uses the writing instrument.

When the use of the writing instrument is ended, the body 1 is rotated in the counterclockwise direction with respect to the guide 1, so that the core 5 disappears into the guide 2 for thereby preventing the core 5 from being damaged by an external impact. Namely, when the body 1 is rotated in the counterclockwise direction, the driving member 4 is rotated together with the body 1 and backwardly moves the moving rod 3, so that the core 5 which is protruded from the front end of the guide 2 disappears into the guide 2. Therefore, in the present invention, when the writing instrument is not used, the core 5 disappears into the guide 2 for thereby preventing any damage of the core due to an external impact.

As described above, the construction and operating structure of the appearing and disappearing core type writing instrument according to the present invention are simple. In addition, the fabrication cost is low, and the life span is long. In addition, the number of friction elements is small, it is possibly to implement a smooth operation.

Korean patent Application No. 2000-27213 filed Sep. 28, 2000 is hereby incorporated by reference.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A writing instrument, comprising:

a hollow cylindrical body having an opened front end;

a driving member which is engaged at an intermediate portion of the body in such a manner that the driving member is not rotated with respect to the body;

a hollow cylindrical guide inserted into the front end of the body and rotatably engaged to the body; and a moving rod which is threadedly engaged with the driving member and is forwardly and backwardly moved by the driving member which is integrally rotated with the body for thereby appearing and disappearing a core through a front end portion of the guide in a state that the core is engaged to the front end of the moving rod and is inserted into the guide and is inserted into a non-rotational through hole formed at the rear end of the guide in such a manner that the moving rod is movable in the forward and backward directions.

2. The instrument of claim 1, wherein said guide is rotatable with respect to the body in such a manner that a protrusion and groove formed in parallel along an outer surface of the end portion of the same are inserted into concave and convex portions formed in parallel along an inner surface of the front end of the body.

3. The instrument of claim 1, wherein said driving member is not rotatable with respect to the body in such a manner that a threaded portion formed in an outer surface of the driving member is engaged with a threaded portion formed in an inner surface of the body.

4. The instrument of claim 1, wherein said moving rod is a rod having a rectangular cross section having a threaded portion formed at both side surfaces, and a through hole formed in a rear end of the guide into which the moving rod is inserted is of rectangular shape to correspond with the cross section of the moving rod.

* * * * *

UNITED STATES PATENT AND TRADEMARK OFFICE

CERTIFICATE OF CORRECTION

PATENT NO. : 6,481,909 B2
DATED : November 19, 2002
INVENTOR(S) : Byung Ho Lee

It is certified that error appears in the above-identified patent and that said Letters Patent is hereby corrected as shown below:

Column 3,
Line 4, “read” should be -- rear --.
Line 13, “holes” should be -- holds --.
Line 20, “toe” should be -- to --.
Line 41, “possibly” should be -- possible --.

Signed and Sealed this

Third Day of February, 2004

JON W. DUDAS
*Acting Director of the United States Patent and Trademark Office*